US009097417B1

(12) United States Patent
Kwon et al.

(10) Patent No.: US 9,097,417 B1
(45) Date of Patent: Aug. 4, 2015

(54) PORTABLE WORK LIGHT

(71) Applicant: INTERLOG CORPORATION, Brea, CA (US)

(72) Inventors: Justin Kwon, La Habra, CA (US); Suk Hee Kim, Anaheim, CA (US)

(73) Assignee: INTERLOG CORPORATION, Brea, CA (US)

( * ) Notice: Subject to any disclaimer, the term of this patent is extended or adjusted under 35 U.S.C. 154(b) by 320 days.

(21) Appl. No.: 13/842,007

(22) Filed: Mar. 15, 2013

(51) Int. Cl.

| | |
|---|---|
| ***F21V 3/00*** | (2006.01) |
| ***F21V 15/01*** | (2006.01) |
| ***F21V 7/00*** | (2006.01) |
| ***F21V 31/00*** | (2006.01) |

(52) U.S. Cl.
CPC ..... *F21V 31/005* (2013.01); *F21V 7/00* (2013.01); *F21V 15/01* (2013.01)

(58) Field of Classification Search
CPC ..... F21V 31/005; F21V 15/01; F21V 7/00
See application file for complete search history.

(56) References Cited

U.S. PATENT DOCUMENTS

| | | | | |
|---|---|---|---|---|
| 5,528,477 | A * | 6/1996 | Carmo | 362/260 |
| 5,716,123 | A * | 2/1998 | Lamming | 362/222 |
| 5,765,941 | A * | 6/1998 | Vest | 362/260 |
| 6,169,373 | B1 * | 1/2001 | Riesinger | 315/200 A |
| 6,964,495 | B2 * | 11/2005 | Schnaufer et al. | 362/378 |
| 7,282,728 | B2 * | 10/2007 | Culbert | 250/504 R |
| 7,527,392 | B2 * | 5/2009 | Kovacik et al. | 362/260 |
| 7,712,916 | B2 * | 5/2010 | Hahn et al. | 362/208 |
| 8,632,207 | B2 * | 1/2014 | Bowen | 362/217.16 |
| 2002/0172037 | A1 * | 11/2002 | Schnaufer et al. | 362/221 |
| 2007/0290627 | A1 * | 12/2007 | Xiequn | 315/291 |

* cited by examiner

*Primary Examiner* — John A Ward
(74) *Attorney, Agent, or Firm* — Lee, Hong, Degerman, Kang & Waimey

(57) ABSTRACT

A reduced emissions work light composed of a two module system for easy assembly and reassembly of component parts. The first module includes a bulb, a ballast, a ballast housing, an end cap, a socket fixture, and an electrical cable. A socket fixture is configured to secure a connection between the ballast housing and the bulb to create a single unitary body. The first module is placed inside a second module to form the reduced emissions work light containing only two separate components.

20 Claims, 15 Drawing Sheets

PORTABLE WORK LIGHT

BACKGROUND OF THE INVENTION

This invention relates to a portable light or light set capable of interconnection with multiple light sets of the same or similar construction to be easily assembled and disassembled for use in modular conditions. The invention is particularly focused toward military and defense organizations used to transport and repair the light set in difficult conditions. Current portable light(s), light sets, or work lights suffer from disadvantages related to time and effort in disassembling and reassembling components for replacements or repairs of interconnected components.

SUMMARY OF THE INVENTION

The present invention will become more fully understood from the detailed description given herein below and the accompanying drawings, which are given by illustration only, and thus are not limitative of the present invention, and wherein:

Therefore, it is an object of example embodiments of the present invention to provide a work light that is able to overcome the deficiencies noted in the current art.

The portable light of the present invention is configured to provide high intensity, lightweight lighting, of flexible usage, rugged construction, extreme durability, and include easily replaceable components. The portable lights may be used in mobile situations that require easy and fast set-up and breakdown. For example, the portable light may be used with the Tent, Extendable, Modular, Personnel (TEMPER) and Modular, Command Post, Systems (MCPS) as used in military operations.

Example embodiments of the present invention include a light set and components thereof capable of storage in extreme high and low temperatures and humidity without defect. A portable light configured to withstand external and internal vibrations and shocks and be configured to operate at low noise levels to provide for use in sensitive areas.

The portable light(s) of the present invention, also referred to herein as work lights or light fixtures, are configured to enable ease of use by containing two main structures. Example embodiments of the present invention include a light fixture consisting of at least two modules. By having the modules connected, the manufacturing process and the set-up and break-down processes are more efficient and simplified. The interconnection between the at least two modules enables easier replacement of internal components, for example, enabling a user to more quickly and safely replace a bulb (or lamp) within a housing of the light set. Fewer steps are necessary to replace a component based on the two-module system of the present invention. Further example embodiments of the present invention allow for a clamp-style socket that secures the connection between the socket and the lamp. Such clamp-style sockets hold the lamp in place, and make the lamp, ballast, cap, and cable into a single module.

Further example embodiments of the present invention include a pad, such as a rubber pad, placed on or around the socket in order to prevent slippage and to absorb internal and external forces acting upon the modules. The locking clamp-style socket is configured to use multiple different lamp bases from different manufacturers, thereby enabling a user to intermix components with ease. Further example embodiments of the present invention include a spring clip that is configured to provide tension and absorb both internal and external forces, such as impact, shock, or vibration that could damage the modules or the lamp.

Further example embodiments of the present invention include a clamp and socket configured to be locked together using different components, for example, by rubber band, spring, VELCRO®, or electrical tape. The portable light can be attached in multiple configurations. For example, the assemblies could be serially attached, radially attached, or attached in parallel. In different configurations, the portable light in a series are configured such that each bulb can be controlled individually or such that a string of portable lights or at least a part of the entirety may be controlled as a group.

A U-shaped cable conduit is made with flexible material to hold a power cable. The cable conduit is attached on a plastic tube and capable of easy installation and removal. Example embodiments of the present invention further include an internal guide that enables a user to quickly and efficiently remove or install a new bulb by allowing a user to align the portions of the module (e.g., rubber caps, lamp, tube and ballast) in the proper orientation.

The two end caps, lamp, tube, and ballast are aligned at assembly or reassembly of the apparatus. The guide is further provided to ease the manufacturing process by enabling a two-step method to set and engage the two modules.

BRIEF DESCRIPTION OF THE DRAWINGS

The present invention will become more fully understood from the detailed description given herein below and the accompanying drawings, which are given by illustration only, and thus are not limitative of the present invention, and wherein.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

As the exemplary embodiments may be implemented in several forms without departing from the characteristics thereof, it should also be understood that the above-described embodiments are not limited by any of the details of the foregoing description, unless otherwise specified, but rather should be construed broadly within its scope as defined in the appended claims. Therefore, various changes and modifications that fall within the scope of the claims, or equivalents of such scope are therefore intended to be embraced by the appended claims.

A description of example embodiments of the invention follows.

Example embodiments of the present invention meet the military requirements for performance specifications of portable fluorescent light sets as detailed in MIL-PRF-44259, Jun. 29, 2009 and additional amendments, which are hereby incorporated by reference in their entireties.

Example embodiments of the present invention include a portable light capable of being interconnected with additional portable light(s) of the same or similar design. The portable light is configured to be water resistant and contain a power supply cord in a fixed or semi-fixed external configuration. Further example embodiments of the present invention include a power cord with a NEMA 5-15 plug ("male component") on one end and a NEMA 5-15 connector/receptacle ("female component") on the opposing end. The power supply is provided via an activation on/off switch maintained in a switch housing for protection and ease of access. The power switch or activation switch can be attached to an end cap and contained in a tube, such as an aluminum tube to connect ballast side end cap, ballast, and socket. Further example embodiments of the present invention include a portable light being operable on at least a voltage of 120 to 240±5 volts alternating current at 50 to 60 Hertz (Hz)±5 Hz. Example embodiments of the present invention maintain a maximum input current draw per portable light of 0.7 amp. Example embodiments of the ballast maintain an input voltage of 100 to 110 VAC (50 to 60 Hz). Other specifications, voltages, and cable types may be interchanged, added, or removed as necessary without deviating from the scope of the invention. Example embodiments of the present invention may be scaled in order to increase or decrease the operability using different voltages.

Figure 1:
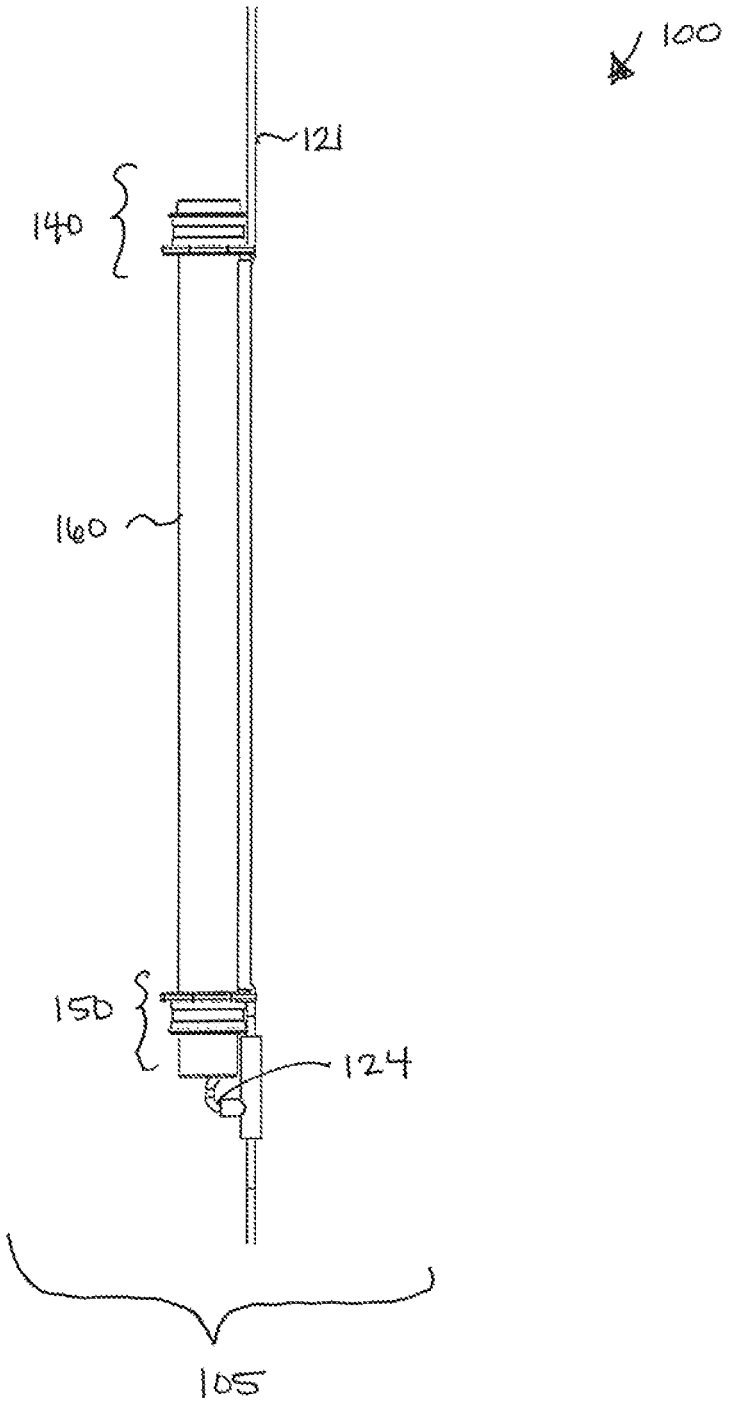
FIG. 1 is an example embodiment of the present invention that illustrates two interconnected modules.

FIG. 1 is an example embodiment 100 of the present invention that illustrates two modules interconnected. Example embodiment 100 includes a portable light 105, which comprises a housing shield 160 that is interconnected with a first end cap 140 and a second end cap 150.

Example embodiments of the present invention further include a T-shape molded power cable 121 with both male and female plugs at both ends. The power cable is attached to the outside of the shield housing and is attached via a method, such as recesses in the shield housing, tape, clamps, bands, or other forms of attachment (not shown) currently known or hereinafter developed that provide a secure connection between the power cable and shield housing. Alternative example embodiments allow for the power cable 121 to be placed in varying positions around or within the portable light 105 as may be required by differing circumstances. The power cable 121 is attached to a U-shape cable conduit 124 comprising a flexible material, semi-flexible material, or rigid material that is configured to hold the power cable 121 on an external side of the light set for easy installation and removal of the power cable 121, as may be necessary for repairs, reconfigurations of light, and transport. Alternative example embodiments of the present invention may include a cable conduit or similar structure for affixing a power cable or other such cable, in a different configuration than a U-shape.

Figure 2:
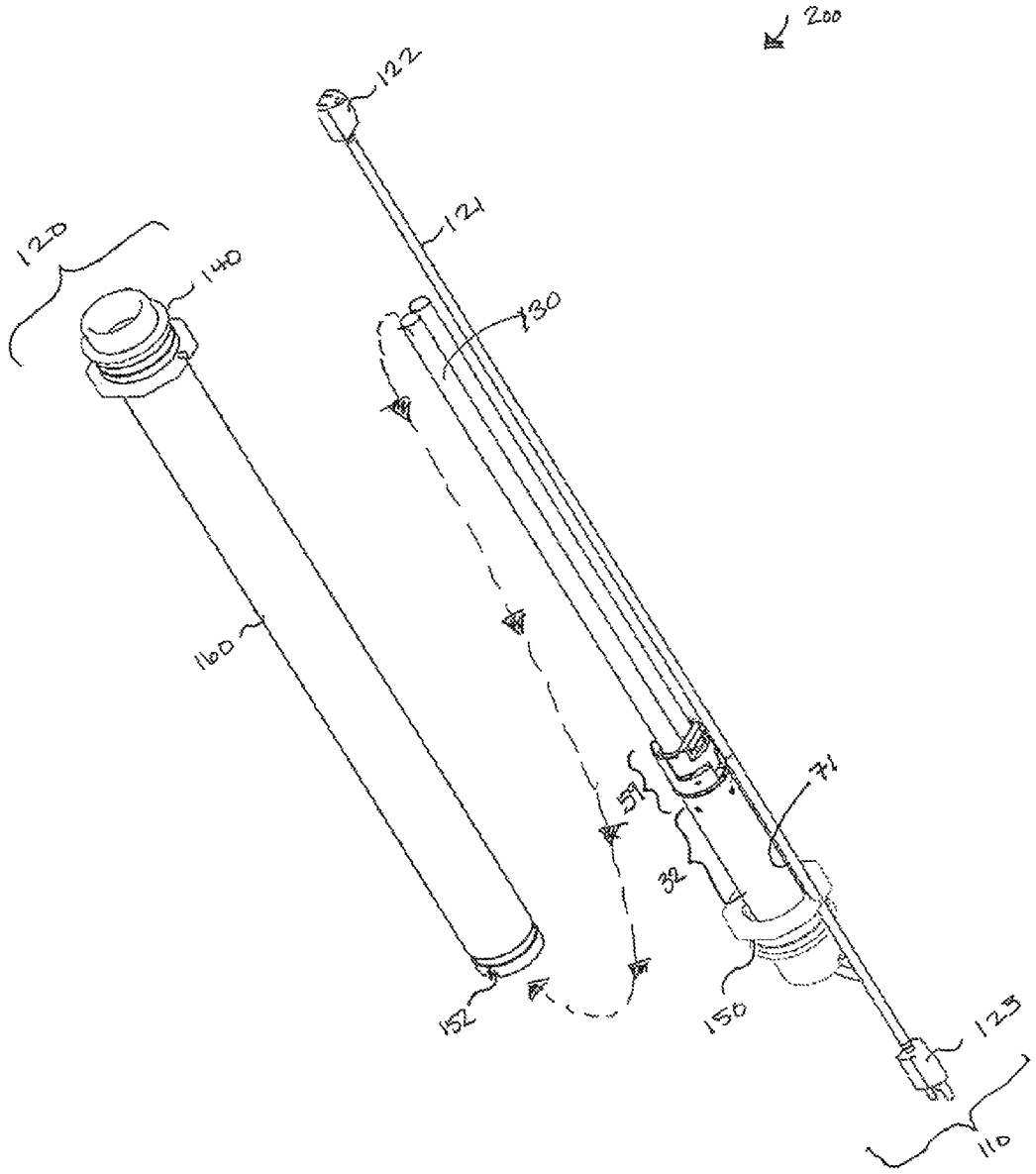
FIG. 2 is an example embodiment of the present invention that illustrates the portable light in a separated configuration displaying the two modules.

FIG. 2 is an example embodiment 200 of the present invention that illustrates two modules. Portable light 105 of the present invention consist of two modules 110 and 120 that comprise all necessary components of the portable light 105. The present invention containing the two modules has advantages in the manufacturing process, assembly, reassembly, and repair because of the simplified construction, fewer steps to complete, and provides a more efficient way to conduct repairs. Other advantages include the ability to have a user having any degree of familiarity with the portable light be able to easily separate the two modules, replace a bulb, and reattach the two modules using alignment pins 151 and alignment grooves 152 that allow for automatic alignment of all components.

Further embodiments of the present invention include a clamp-style socket 59 that provides a secure and steady connection between the clamp-style socket 59 and bulb 130. The clamp-style socket 59 further allows the bulb 130, ballast housing 32, socket (not shown), socket-side end cap 150, and power cable 121 be unified into one module, such as a first module 110.

Example embodiments of the portable light 105 of the present invention comprise two main modules. A first module comprising a socket-side end cap, ballast housing, a socket (not shown), an activation switch, and power supply cords (such as cable 121) is assembled as a unity structure that is connected to a bulb 130 to form the first module 110. A second module 120 comprises a housing shield 160 interconnected to a bulb-side end cap 140.

The first module 110 is inserted into the second module 120 according to alignment groves 152 on the housing shield 160 and the mating alignment pins (not shown) of the end caps 140 and 150. The two module system enables a user to separate the two main components in order to repair or replace component parts and easily reassemble the two main components by re-inserting the first module 110 into the second module 120. The two modules easily separate from each other and the power supply cord can be removed and remounted as necessary.

Figure 3:
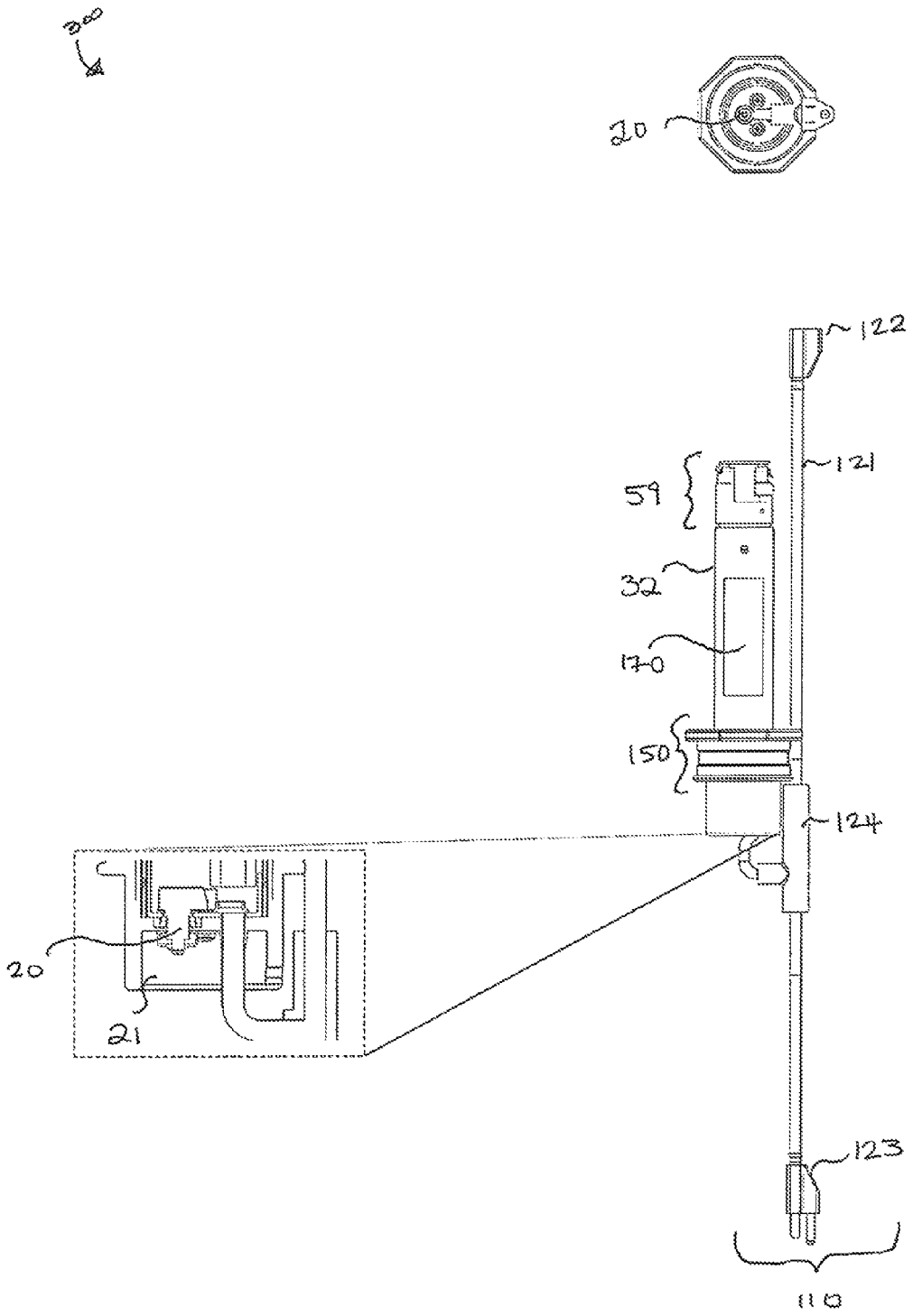
FIG. 3 is an example embodiment of the present invention that illustrates a module and related components.

FIG. 3 is an example embodiment 300 of the present invention that illustrates a module and related components. Example embodiments of the present invention connect the fluorescent bulb to a ballast, such as a printed circuit board, in order to regulate current flow through the bulb. Examples may include an electronic ballast configured to be placed within an emissions containment housing that is further placed within a ballast housing. In some example embodiments, the separate emissions containment housing configured to specifically hold the electronic ballast, with emissions containment housing is further contained within the ballast housing 32 that is shown interconnected to the socket side end cap.

In example embodiments of the present invention, a ballast activation switch 20 is attached to the socket-side end cap 150 and is contained in the ballast housing 32 in order to connect the socket-side end cap 150, ballast housing 32, and clamp-style socket 59.

In some example embodiments of the present invention, the bulb-side end cap 140 is a shock-absorbing end cap containing a plug integrated with the end cap that has at least one alignment pin in order to provide a direct alignment with the bulb being connected. Example embodiments of the present invention have at least two alignment mechanisms in each end cap, i.e., the socket-side end cap and the bulb-side end cap. Each alignment mechanism has a mating mechanism inside the housing. For example, the alignment pins of the end caps would pair with the alignment grooves 152 in the housing shield 160 (also referred to as a "housing tube").

Such example embodiments allow for simple installation and assembly under varying circumstances by enabling a user to connect the first module 110 and the second module 120 by aligning the pins 151 and grooves 152. No other considerations or steps need be taken in order to reassemble the two modules.

Example embodiments of the cable conduit 124 are placed in locking grooves 152 or recessed mechanisms along the outside of the portable light 105 by placing the cable 121 into and securing it to the alignment grooves 152. The cable and cable conduits can be coated or protected using different materials in order to protect against corrosion such that all cables and extraneous wiring are insulated with enough material to protect against abrasions.

Example embodiments of the present invention include mounting brackets or hardware to interconnect cables to the necessary components. Such hardware is capable of removal or change in position where necessary. In some example embodiments, two electrical cables are interconnected to the housing tube such that each side of the housing tube has a male and a female component.

Figure 4A:
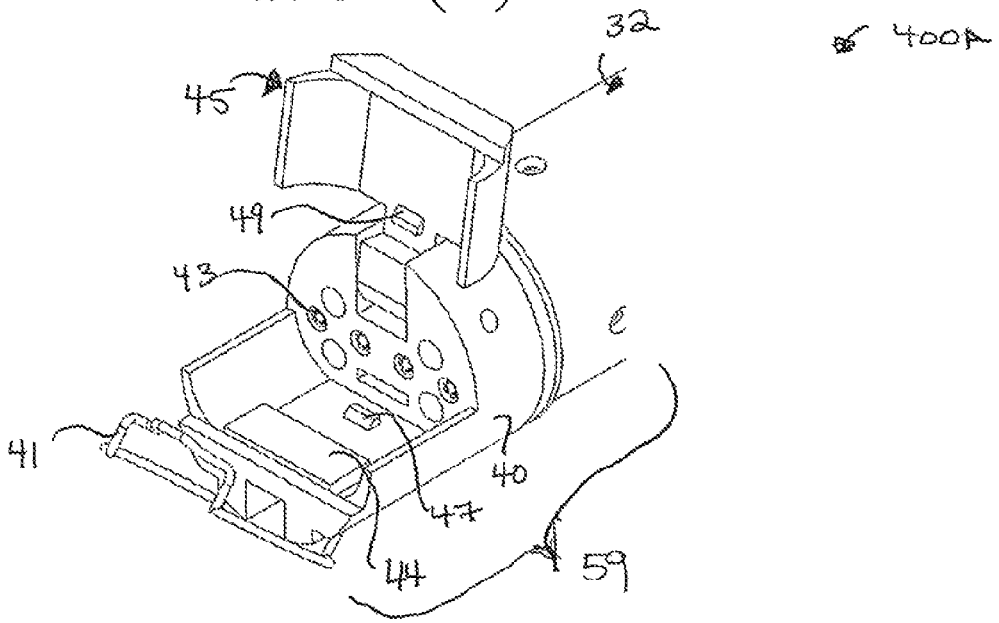
FIG. 4(A) is an example embodiment of the present invention that illustrates an open socket and component.

FIG. 4(A) is an example embodiment 400A of the present invention that illustrates an open socket and component. At least one PCB (see FIG. 8) is attached inside an emission containment housing that is placed inside a ballast housing 32. The ballast housing 32 is interconnected with the bulb 130 via a terminal with through bores 43 located on one end for coupling with electrode pins 42 of the bulb. Alternative connection methods may be used in example embodiments of the present invention as may be necessary to connect a ballast housing 32 to a bulb 130. In example embodiments of the present invention, the bulb (as shown in FIG. 4A) is connected to the ballast housing 32 via a socket 40 of the first module of the portable light 105. The socket 40 includes components to be interlocked in a manner that creates a secure and protected connection.

The interconnection of the bulb 130 and ballast housing 32 via the socket 40 enables addition protection from external and internal forces, such as turbulence, vibrations, shock, and other hazards that may be encountered during transportation and/or use of the portable light 105.

Example embodiments of the clamp-style socket 59 of the present invention further include a disturbance-absorbing element 44, such as a rubber pad, that is placed on the socket 40 to prevent the bulb 130 from slipping and to absorb any impact from external and internal movement. The disturbance absorbing element 44 may be constructed of multiple materials and/or sizes. Additional example embodiments of the clamp-style socket 59 of the present invention are configured to securely hold various lamp bases from different manufacturers.

Example embodiments of the present invention include a spring clip 41 that provides tension between the clamp 45 and the bulb 130; the spring clip 41 also absorbs internal and external forces that may disturb or damage the bulb 130 or components attached to the bulb. The clip 41 is not limited to a spring clip, and may be substituted with other forms of attachment pieces or components that provide the required tension and support against impacts, shock, vibration, and other forces that may damage the portable light 105.

Example embodiments of the present invention include a socket 40 that is interconnected with a clamp 45, a spring clip 41, and a shock-absorbing pad 44. When the electrode pins 42 of the bulb are snapped into the through bores 43 of the ballast housing 32, the base 46 of the bulb 130 is placed over the base of the socket such that a bulb base connector 48 engages a socket base connector 47 for additional stability. The base (not shown) of the bulb 130 is additionally placed on top of the shock-absorbing pad 44, which provides additional stability and protection from external and internal forces acting upon the portable light 105. Further example embodiments include a spring clip 41, to ensure a tight fit between the socket 40 and the bulb 130 and provides for external protection of the bulb material. In alternative example embodiments of the present invention, the spring clip 41, clamp 45, and shock-absorbing pad 44 may be used in different configurations or made of different materials that are currently known or hereinafter developed.

Example embodiments of the present invention include the socket 40 comprising of a single material or multiple materials. The socket 40 may be comprised of polycarbonate, steel, acrylonitrile butadiene styrene (ABS), or other such materials currently known or hereinafter developed with high impact resistance, toughness, and heat resistance or other resilient material (thermoplastic).

Further example embodiments of the present invention include the clamp-style socket 59 comprising a clamp 45, a clip 41, and through-bores 43 for terminal connection in a single unitary socket, in which the clamp-style socket 59 is formed of the same material. Further example embodiments of the present invention include the socket 40 configured with an enlarged opening for receiving electrode pins 42 of the bulb 130 via longitudinal through-bores 43.

Figure 4B:
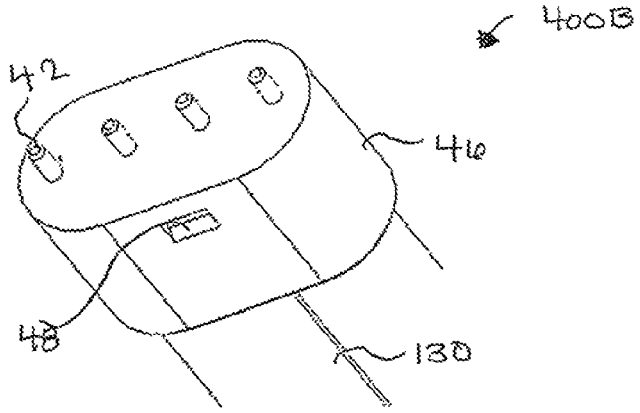
FIG. 4(B) is an example embodiment of the present invention that illustrates a lamp with interconnection components

FIG. 4(B) is an example embodiment 400B of the present invention that illustrates a bulb 130 with interconnection components including a bulb base connector 48 and a bulb base 46. The types of bulbs used in example embodiments of the present invention are typically fluorescent lamp tubes. Other lamp tubes capable of reduced-emissions as are currently known or hereinafter developed may be interchanged. Typical fluorescent lamp tubes are a straight, elongated tube; however, alternative example embodiments of the bulb of the present invention can be constructed in different lengths, shapes, sizes, and configurations.

Figure 4C:
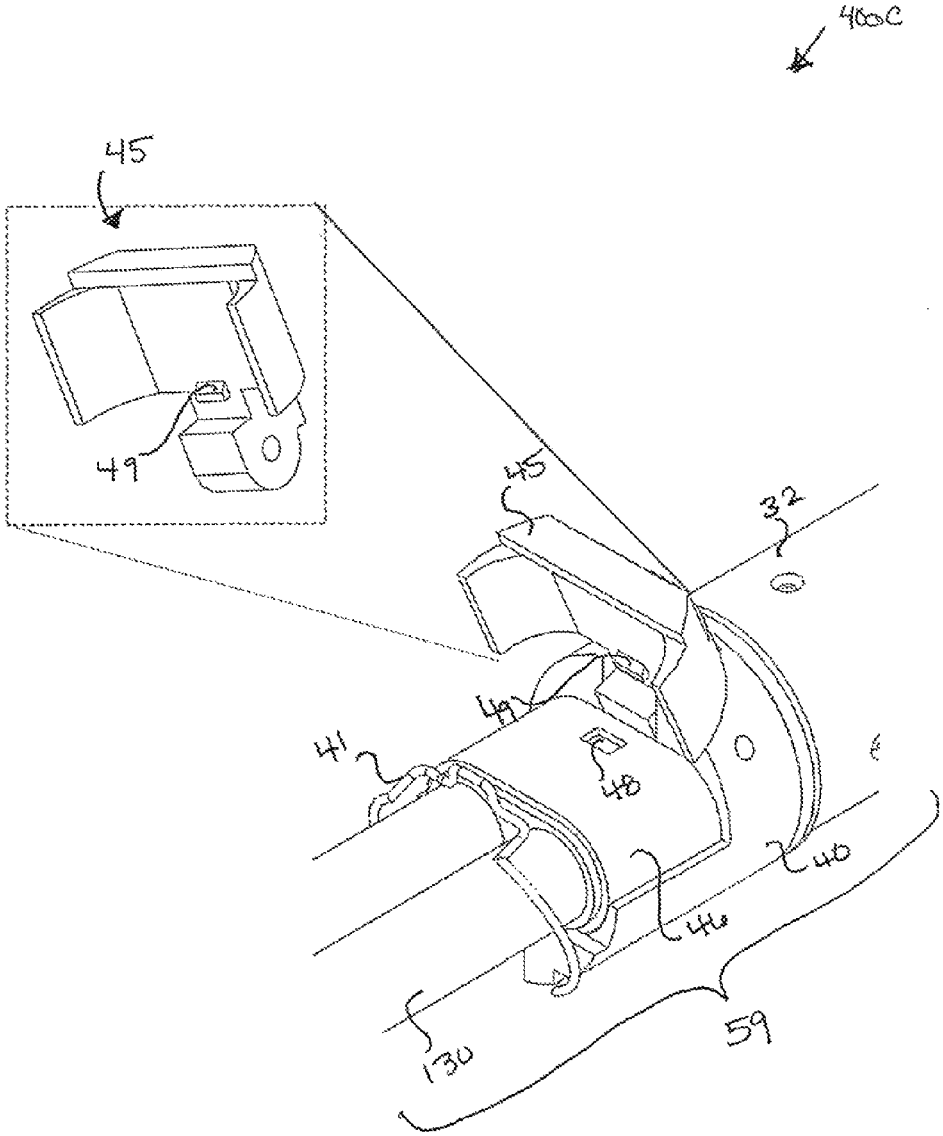
FIG. 4(C) is an example embodiment of the present invention that illustrates a clamp configured to interconnect with a lamp and other components of the supporting structure and an open socket configuration including a lamp and ballast connection.

FIG. 4(C) is an example embodiment 400C of the present invention that illustrates an open socket configuration including a bulb 130 connected to a ballast housing 32 and a clamp 45 configured to interconnect with the bulb 130 and other components of the supporting structure. In example embodiments of the present invention, the clamp 45 may include a clamp base connector 49 that is configured to engage with an additional connector component located on the bulb base 46 or surrounding area in different bulbs. Such connector components may be a male and a female locking mechanism that snap into place upon connection and closure. As example embodiments of the present invention can accommodate different lamp bases and bulb styles, the connector components may or may not be used depending on the structure of the bulb type and additional shapes or methods of combining or interconnecting the components may be used.

The bulb 130, clamp-style socket 59, and ballast housing 32 are further connected with a first end cap 150. Example embodiments of the present invention include a first end cap 150 on the first module 110, hereinafter referred to as a socket-side end cap 150. The socket-side end cap 150 is configured to interconnect to the ballast housing 32.

Figure 4D:
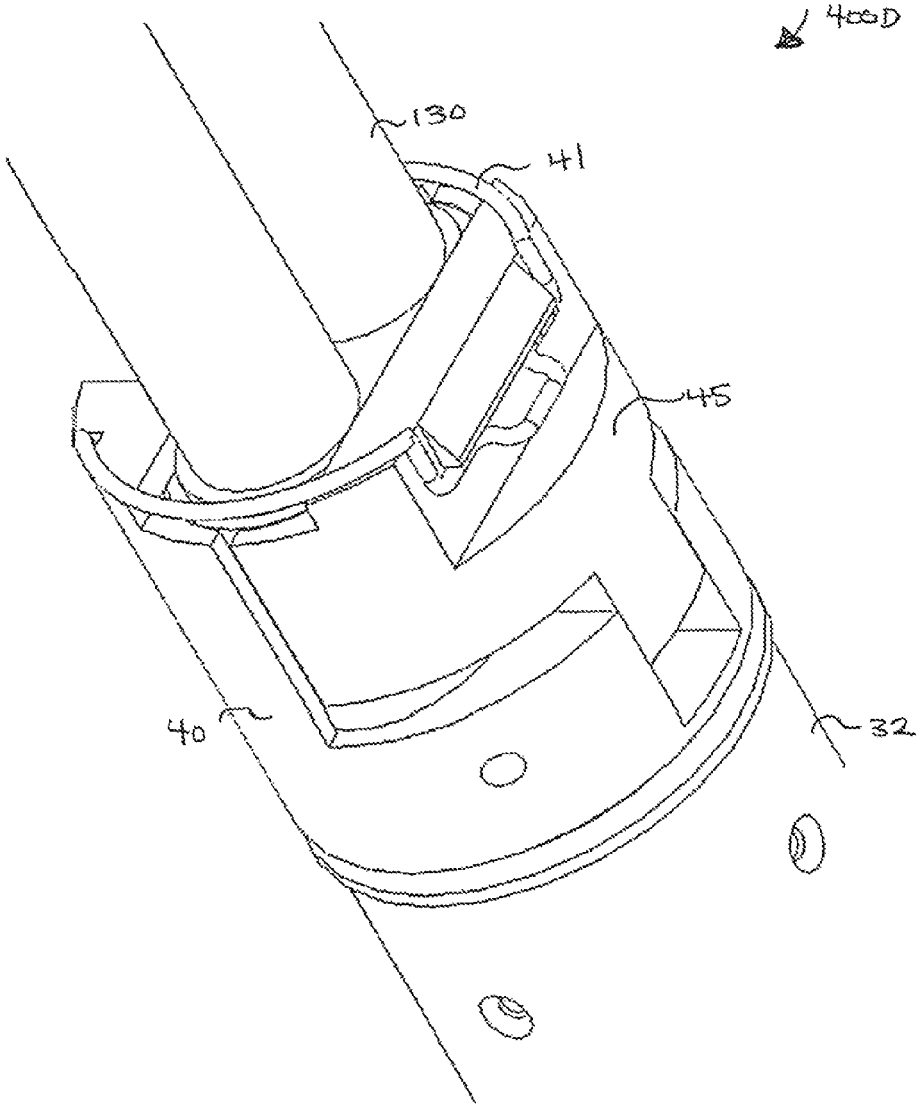
FIG. 4(D) is an example embodiment of the present invention that illustrates a closed socket configuration interconnecting the lamp and other components in a secure manner.

FIG. 4(D) is an example embodiment 400D of the present invention that illustrates a closed socket configuration interconnecting the bulb 130 with other components in a secure manner. The example embodiment 400D illustrates that once a bulb 130 is connected with the ballast housing 32, the clamp 45, clip 41, and socket 40 are engaged such that the ballast housing 32 is securely interlocked with the bulb 130.

Figure 5A:
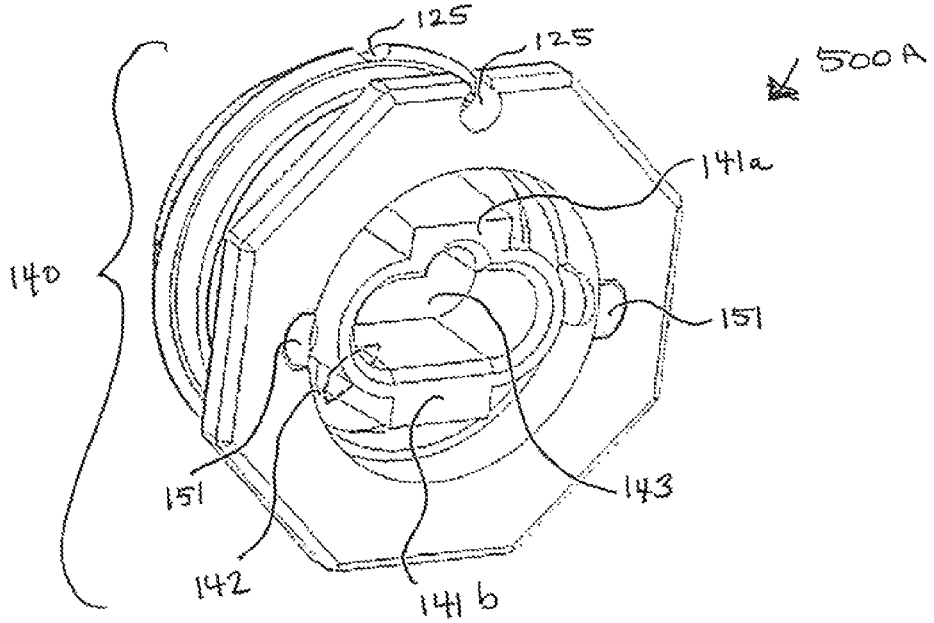
FIGS. 5(A) and 5(B) illustrate example embodiments of end caps of the present invention.
Figure 5B:
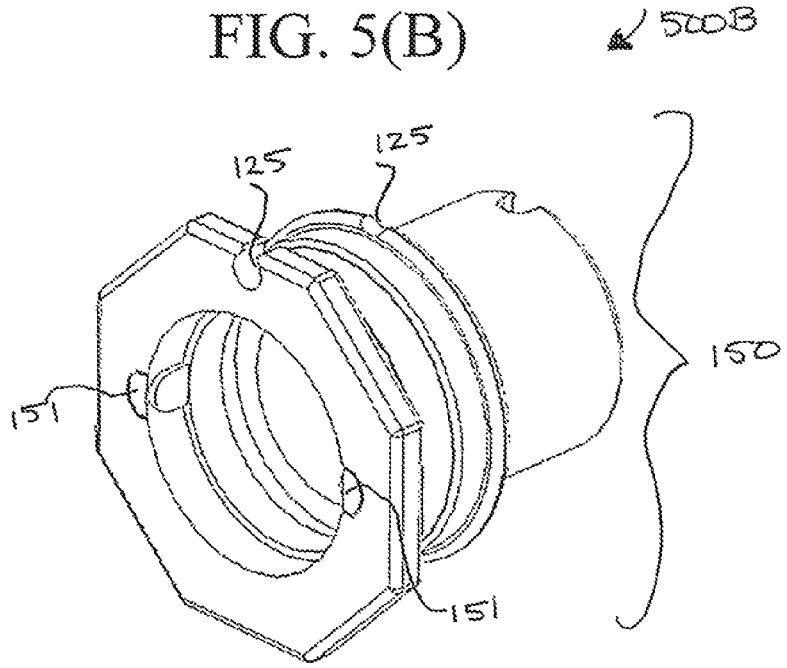

FIGS. 5(A) and 5(B) illustrate example embodiments of multiple end caps 140, 150 of the present invention. The end caps of example embodiments of the present invention secure the two modules 110, 120 of the portable light together with all or a portion of the other components. The end caps provide multiple functions that protect the portable light from internal and external disturbances and forces acting on the end cap(s), such as shock, dropping, transport, and vibration. Further functions provided by the end caps include securely holding the bulb and providing additional guide and alignment functions utilizing built-in features.

Example embodiments of the present invention include guide structures, such as alignment pins 151 and alignment grooves 152 (see FIG. 6) that guide all components of the portable light 105 to the proper alignment and orientation of the portable light. Such guide structures may comprise other alignment techniques that enable reassembly of the portable light 105 such that the components cannot be reattached in an improper manner. This is beneficial for inexperienced users and experienced users alike and allows for simple and quick fool-proof reassembly.

FIG. 5A is an example embodiment 500A of the present invention that illustrates the bulb-side end cap 140. Example embodiments of the bulb-side end cap 140 include a wrapping membrane 142 and studs 141*a* and 141*b* that securely attach the bulb 130 to the bulb-side end cap 140 in the proper orientation. The wrapping membrane 142, stud(s) 141*a* and 141*b*, and a bulb-shaped plug 143 are recessed in the bulb-side end cap 140 to enable the bulb 130 to directly enter the space and be securely wrapped by supporting structures.

Example embodiments of the end cap(s) 140, 150 further provide shock absorbing functions. Example embodiments of the bulb-side end cap 140 are configured in an octagonal shape to prevent the lamp assembly or bulb 130 from rolling within the portable light 105; additional shapes may be used for the bulb-side end cap 140.

Further example embodiments of the present invention include a shock-absorbing plug integrated with the bulb-side end cap 140. The integrated shock-absorbing plug and alignment components enable a user to automatically align the first module 110 comprising the bulb 130 into the second module 120 with bulb-side end cap 140. Alignment is vital since the socket 40 and lamp are configured in specific orientations.

Further example embodiments of the cap are configured into a unitary body such that the cap and bulb holder are a single piece. Example embodiments of the cap may comprise a wrapping membrane and supporting stud, such as studs 141*a* and 141*b*, to securely hold the lamp into a proper alignment that are configured as a single element of the same material.

FIG. 5B is an example embodiment 500B of the present invention that illustrates the socket-side end cap 150. Further example embodiments of the present invention include at least one cap that is configured to absorb internal or external forces such as impact, shock, or vibration that may damage the lamp assembly during assembly, reassembly, or transport.

The socket-side end cap 150 may be configured in an octagon-like manner in order to prevent the lamp assembly from moving within the housing. Such an octagon-like molding is based on the specifications of the portable bulbs being used within the apparatus and such the cap shape could be modified to other shapes as may be currently used or hereinafter developed for the purposes disclosed herein without deviating from the scope of the invention. Further example embodiments of the present invention include a physical protection for membrane (portion) for the cable and push-button switch.

Figure 6:
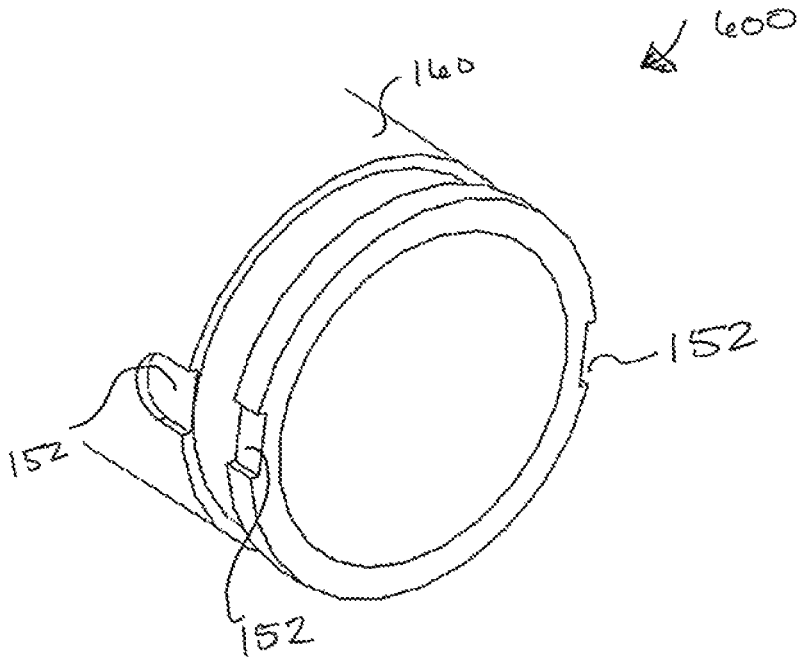
FIG. 6 illustrate example embodiments of a PC tube of the present invention.

FIG. 6 illustrates an example embodiment 600 of a shield housing (e.g., PC tube) of the present invention. Example embodiments of the present invention include guide structures, such as alignment grooves 152 on the inside or outside of the shield housing to provide proper alignment and orientation of the portable light. The housing shield 160 is interconnected with the bulb-side end cap 140 of FIG. 5A to create the second module 120 of the present invention. Example embodiments of the housing shield 160 can include a reflector system, a color filter, and/or an internal or external emissions filter either internally or externally, or some combination thereof (see FIG. 11).

Figure 7:
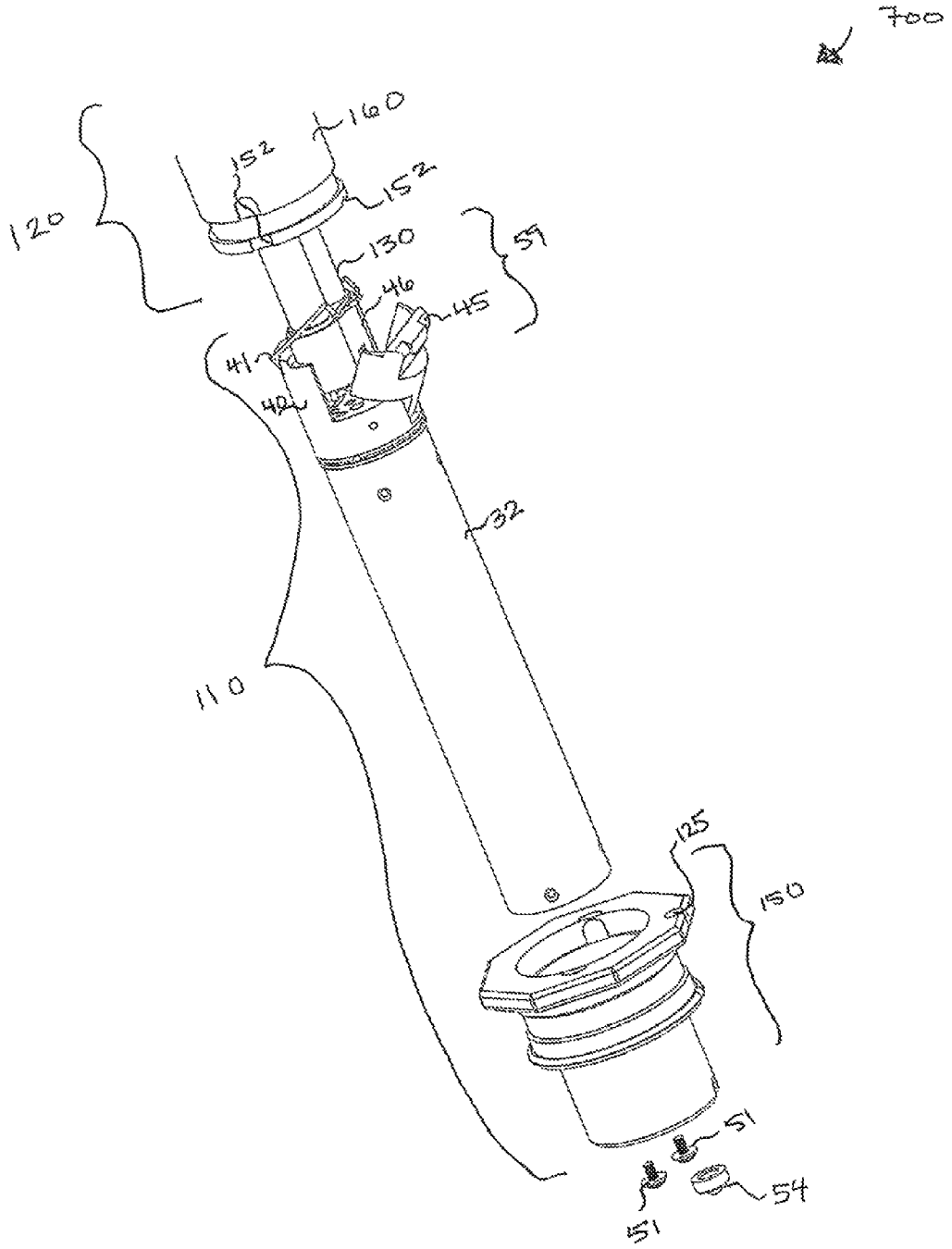
FIG. 7 is an example embodiment of the present invention that illustrates multiple components of a first module and a second module during connection.

FIG. 7 is an example embodiment 700 of the present invention that illustrates multiple components of a first module 110 connected to a second module 120. The first module 110 including the bulb 130, the clamp-style socket 59 (which comprises of the spring 41, the bulb base 46, the clamp 45, and the socket 40), the ballast housing 32 (which can surround a filter PCB and/or a ballast PCB of FIG. 9), and the socket-side end cap 150 are interlocked into the second module 120 using the alignment grooves 152 on the housing shield 160. By interlocking the first module 110 and the second module 120, the portable light 105 is complete.

Figure 8:
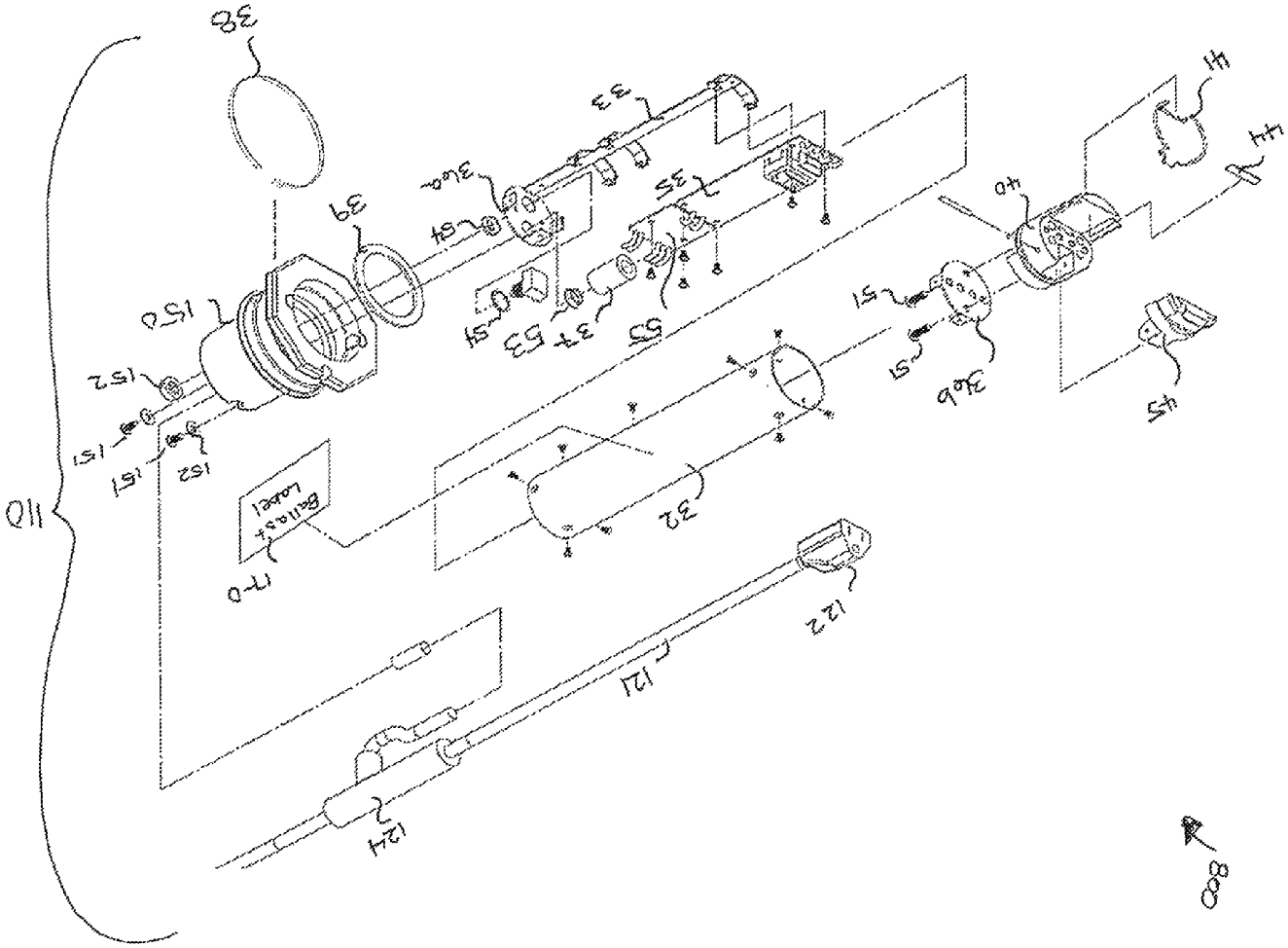
FIG. 8 is an example embodiment that illustrates an exploded view of components of one module of the present invention.

FIG. 8 is an example embodiment 800 that illustrates an exploded view of components of the portable light 105 of one embodiment of the present invention. The example embodiment 800 illustrates at least some of the components incorporated in the first module 110 including guidelines to illustrate the method of combining the specified components. Specifically, in example embodiments of the present invention, a first module 110 includes a power cable 121 cord with a female end 122 and a male (not shown) that are interconnected via a cable conduit 124. The socket-side end cap 150 is interconnected with a ballast housing 32.

Example embodiments of the ballast housing 32 can include at least a printed circuit board, such as a ballast PCB 35 and an EMI filter PCB 55, aligned in a holding tray 33 that is placed within the ballast housing 32. The ballast housing 32 is capable of including a label or one may be affixed thereon or therein, such as ballast label 170. The ballast housing 32 has a first end connected to the socket-side end cap 150 via a first ballast cap 36*a*.

In some example embodiments, the socket-side end cap 150 is connected to the first ballast cap 36*a* via a gasket 39 to enhance sealing for humidity, which can be placed on both of the end caps; other methods of sealing out moisture may be used in place of the gasket 39. Example embodiments of the present invention further interconnect the ballast housing 32 with a second ballast cap 36*b* that is further connected to the socket 40, clamp 45, rubber pad 44, and spring 41. Interconnections can be made with hardware 54 currently known or hereinafter developed, such as screws 51 or washers 52.

Figure 9:
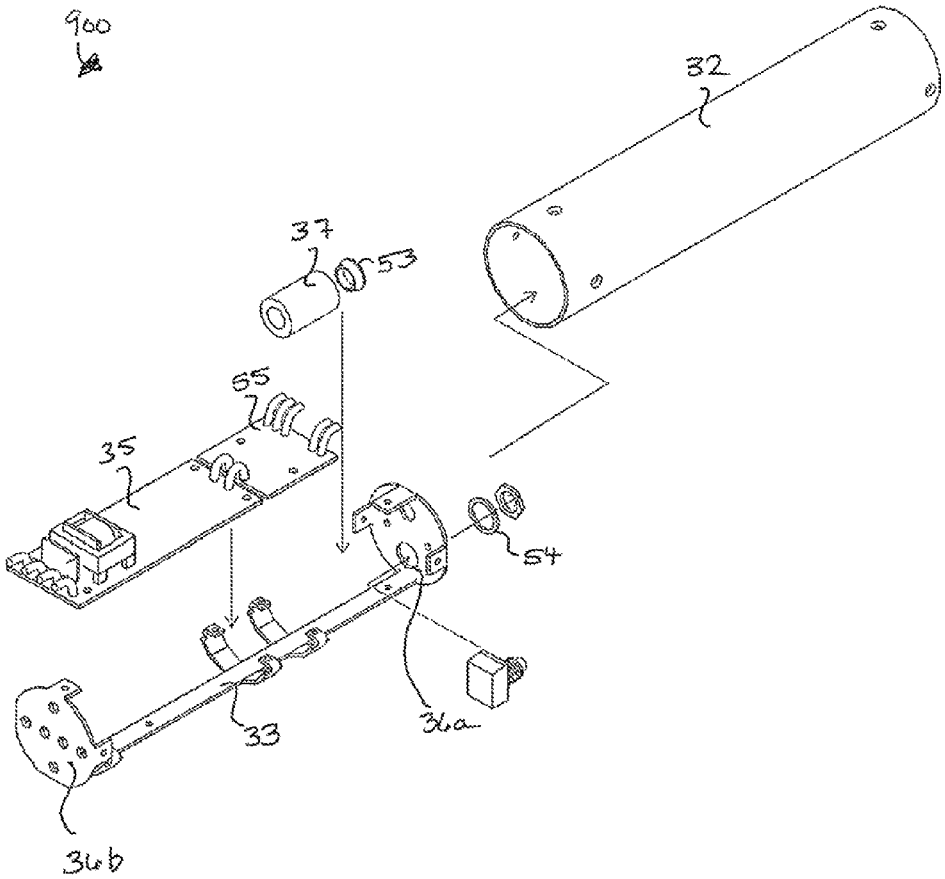
FIG. 9 illustrates an exploded view of components of a printed circuit board and ballast.

FIG. 9 illustrates an exploded view 900 of components contained within the ballast housing 32 of an example embodiment of the present invention. Example embodiments of the present invention include at least one printed circuit board (PCB), such as ballast PCB 35 that is set into a holding tray or component that efficiently holds the ballast PCB 35 and a filter circuit, such as EMI filter PCB 55, in a manner that saves room and assembly time. Example embodiments of the holding tray 33 are configured in an open manner such that the holding tray may be separated from the PCB 35 for easy repair and inspection.

Example embodiments of the present invention are configured to implement a filter circuit to reduce EMI emissions without the need of additional insulating layers or extraneous components. Example embodiments of the present invention include an EMI filter 55 to reduce the EMI signal by electronic filtering. For example, the filter PCB 55 can be configured with Ferrite bead 37 in order provide a passive electronic component used to suppress high frequency noise in electronic circuits. The filter PCB 55 can be used to prevent or help prevent EMI noise through power connections. In some example embodiments, the Ferrite bead 37 may interconnected with hardware components used for strain relief, such as component 53. Where the ballast PCB 35 and the filter PCB 55 are separate circuits interconnected.

Further example embodiments of the present invention include the holding tray 33 and hardware 54 comprised of electrically conductive material, such that the holding tray 33 and hardware 54 (or other attachment pieces) work as electrical grounds or earth to eliminate ground wiring. Such electrical grounding characteristic of the holding tray 33 saves time and cost of the components. Example embodiments of the holding tray 33 include end caps 36*a* and 36*b* at proximal ends of the tray that comprise electrically conductive material. When the holding tray 33 is assembled with the ballast housing 32, the ballast PCB 35 and filter PCB 55 is covered by an electrically conductive material that provides for omnidirectional conductivity.

Figure 10A:
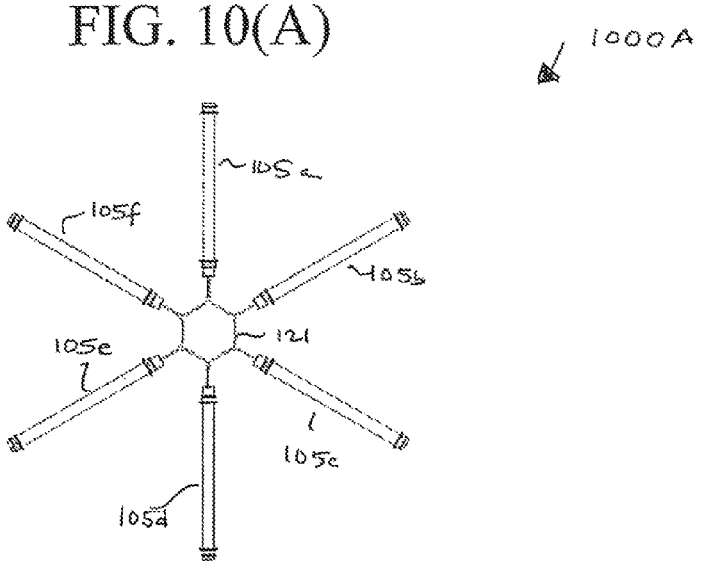
FIG. 10(A) is an example embodiment that illustrates a radial connection of assembled components of the present invention.
Figure 10B:
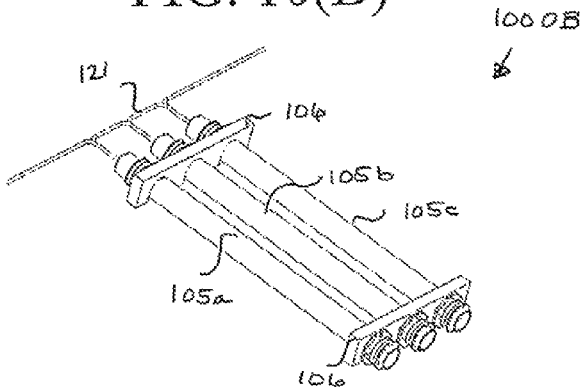
FIG. 10(B) is an example embodiment that illustrates a serial connection of assembled components of the present invention.
Figure 10C:
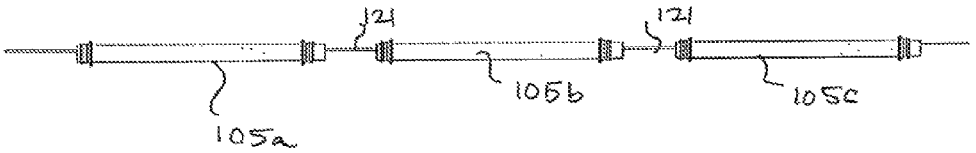
FIG. 10(C) is an example embodiment that illustrates a parallel connection of assembled components of the present invention.

FIG. 10(A) is an example embodiment that illustrates a radial connection of assembled components of portable light 105 according to one embodiment of the present invention. FIG. 10(B) is an example embodiment that illustrates a serial connection of assembled components of portable light 105 according to one embodiment of the present invention. FIG. 10(C) is an example embodiment that illustrates a parallel connection of assembled components of portable light 105 according to one embodiment of the present invention. Easy to organize end power cables 121 include mechanisms to provide a variety of wiring functions and shapes for different configurations of the portable light 105 in assembly.

For example, some such configurations could include connecting multiple work light structures in a radial assembly (FIG. 10A) that may be similar to a hub-and-spoke pattern that collapses in the center for ease of transport. Other such structures could include a serial assembly or a parallel assembly of multiple work light structures.

Example embodiments of the portable light 105 may be used individually or interconnected with additional portable lights 105. When multiple portable lights 105 are interconnected, each portable light 105 is able to be individually controlled, e.g., the portable light 105 can be activated and deactivated on a per-portable light basis. In other example embodiments, interconnected portable lights 105 are configured to be operated as a single unit, e.g., all portable light 105 in the interconnected assembly may be activated and deactivated as a group. Further example embodiments of the present invention enable each portable light 105 to be individually controlled to increase or decrease the intensity of the visible lights. Further example embodiments of the present invention include a portable light interconnected to additional portable light 105 in order to provide power via the light assembly to the next light assembly when connected in series regardless of the position of the power switch of each portable light 105.

Alternative example embodiments of the present invention include interconnecting multiple portable lights 105 while plugged into (connected to) a ground fault circuit interrupter (GFCI). Further example embodiments include each portable light 105 in an assembly of multiple portable lights 105 operating independently on the through power circuit.

Figure 11:
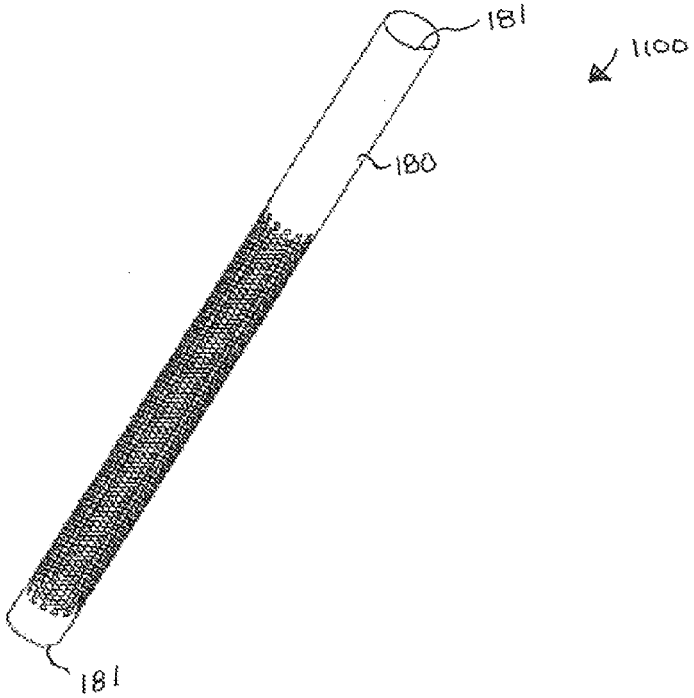
FIG. 11 is an example embodiment that illustrates an electromagnetic interference shield of the present invention.
Figure 11:
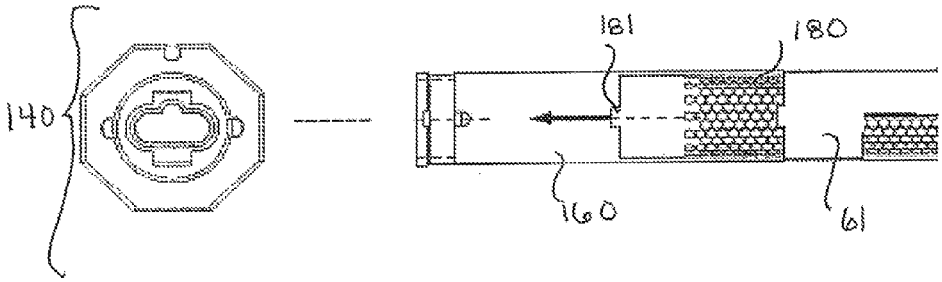

FIG. 11 is an example embodiment 1100 that illustrates an electromagnetic interference (EMI) emissions shield 180 according to one embodiment of the present invention. Example embodiments of an EMI shield 180 can be formed out of metal or other grounding substances that allow for the EMI shield 180 to be electrically grounded via its connection with a ballast ground. Example embodiment of the EMI shield 180 may be used to collect EMI noise emitted into the air interface. The EMI shield 180 and containment housing (not shown) enable the EMI signal to be returned to the ground by connecting the containment housing with the ground unit. Example embodiments of the present invention using two notches 181 enable the EMI shield 180 to be easily aligned with the housing shield 160.

Further example embodiments of the present invention include a reflector component 61 that also includes guide structures for alignment of the reflector 61 with the EMI shield 180 when the reflector is connected with or wrapped around the surface of the EMI shield 180. In example embodiments of the present invention, a light reflector 61 is configured to be easily placed within the internal portion of the housing shield 160 of the second module 120 as in FIG. 1. The reflector is configured with at least two notches placed at proximal ends of the reflector in order to allow easy alignment with the EMI filter when the reflector is wrapped around the surface of the EMI filter. Example embodiments of the reflector may include a reflector on the housing shield to better heat dispensing of a bulb and reduce distortion or aging from heat.

Further example embodiments of the present invention include a reflector consisting of two layers. A front side layer is a printable surface that is made of a white plastic sheet and the back side layer is a reflective surface that is made of metalized plastic or high reflective materials. The reflector layers serve multiple purposes; including providing places for labels indicating instructions for interchanging or replacing components of the portable light 105.

Alternative embodiments of the present invention include additional or different alignment guides and the reflector may consist of other materials as may best suit the circumstances. Alternative embodiments of the present invention further include a light reflector being placed in other locations on or in the first module 110 or the second module 120 and the light reflector may be added or removed as necessary. In some such example embodiments, the light reflector 61 attached to the inside of the housing tube allows for improved heat dispensing and the reduction of distortion and aging due to the heat of the bulb.

Figure 12:
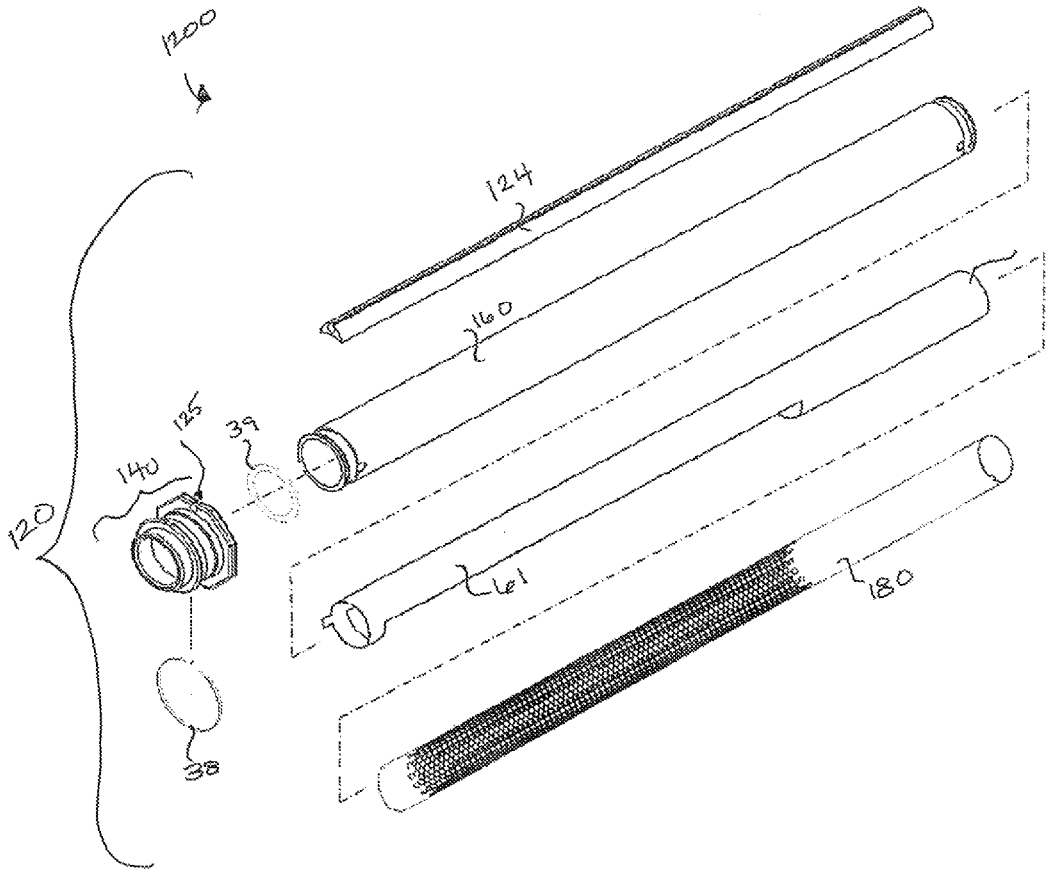
FIG. 12 is an example embodiment that illustrates an exploded view of components in a second module of the present invention.

FIG. 12 is an example embodiment 1200 that illustrates an exploded view of a second module 120 of the portable light 105 of one embodiment of the present invention. The example embodiment 1200 illustrates at least some of the components that may be incorporated in the second module, such as module 120 in FIG. 2. Specifically, in example embodiments of the present invention, the second module 120 includes a housing shield 160 being of appropriate size to encompass at least the components of a first module, such as module 110, and further including a reflector 61 and an EMI shield 180 (as in FIG. 11). The EMI shield 180 and/or reflector 61 may be inserted in the housing shield 160, and a cable conduit, such as U-shaped cable conduit 124 may be interconnected to the outside surface of the housing shield. The conduit 24 may be affixed to the components in different orientations as required.

Alternative example embodiments of the present invention include the housing shield 160, and inserted contents, being connected with a first end cap, such as the bulb side end cap 140 in FIG. 5A. The housing shield can be connected the bulb side end cap with additional components liking the two components, such as a gasket 39. The cable conduit 124 is configured to align with cable conduit recesses 125 on the end cap. A cable tie 38 is further interconnected with the end cap 140 in order to improve the connection seal.

Figure 13:
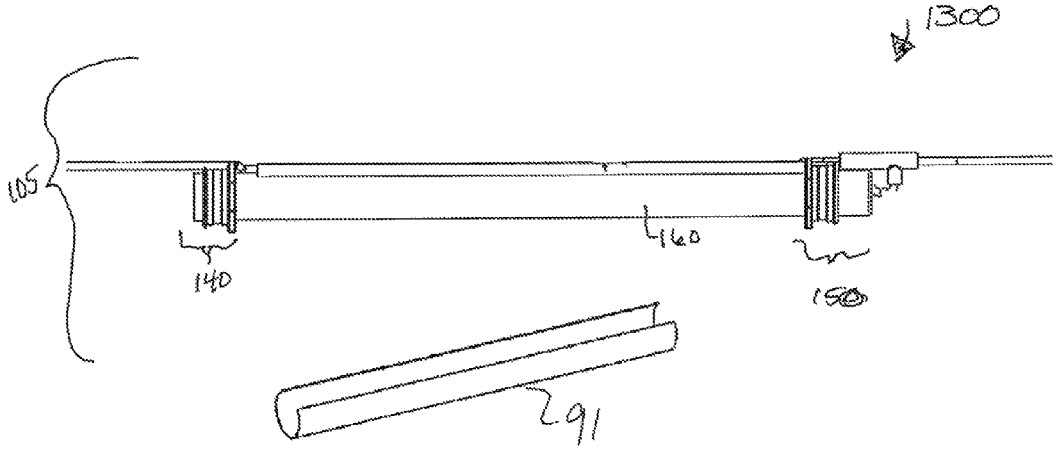
FIG. 13 is an example embodiment that illustrates a colored filter of the present invention.

FIG. 13 is an example embodiment 1300 that illustrates a colored filter, such as a blue filter 91, to reduce light according to one embodiment of the present invention. Example embodiments of the present invention include a filter to reduce the illumination of the portable light 105. Some example embodiments of the filter comprise polyethylene terephthalate (PET). Other example embodiments may comprise other semi-rigid to rigid lightweight materials as currently known in the art or hereinafter developed. Example embodiment 1300 includes an example of the portable light 105, such as the portable light 105 in FIG. 1, and the colored filter, such as a blue colored filter 91, that can be place over or around the portable light in full or in part. The colored filter 91 may include other colors, alone or in combination, that are used to reduce light illumination for the purpose of covering the portable light.

Alternative example embodiments of the present invention can include a PCB holding part efficiently holds ballast PCB and filter PCB to save volume and assembly time. Attaching PCB in the tube is very difficult but tray is separated and open structure to make easy to assemble and repair. PCB holding part and screws were made electrically conductive material, so it works as electrical ground or earth to eliminate ground wiring. It saves time and cost. Alternative example embodiments further include a PCB holding part has cap of both end of tube with electrically conductive material. Once PCB holding part is assembled with the tube, PCBs is covered by electrically conductive material omni-directionally. PCB holding part and tube work as an omni-direct.

While this invention has been particularly shown and described with references to example embodiments thereof, it will be understood by those skilled in the art that various changes in form and details may be made therein without departing from the scope of the invention encompassed by the appended claims.

What is claimed is:

1. A portable light comprising:

a removable bulb;

a first module comprising a ballast housing, a ballast, a filter circuit, a socket segment, a gasket, an end cap, a cable tie, and a power supply cord interconnected with the removable bulb; and a second module comprising a shield housing, a reflector, an electromagnetic interference (EMI) shield, a gasket, an end cap, and a cable tie, wherein the first module is configured to be directly inserted into the second module.

2. The portable light of claim 1, wherein:

the socket segment comprises a clamp, a clip, through-bores, and a socket to form a unitary body, and the unitary body comprises of a single material.

3. The portable light of claim 2 wherein the socket segment comprises a clamp-style socket configured to lock the ballast housing to the removable bulb.

4. The portable light of claim 1, further comprising a light reflector located in the shield housing and configured to distribute light and disperse bulb heat and reduce distortion or aging.

5. The portable light of claim 1, wherein the first module further comprises the removable bulb, a switch, a cap, and the power supply cable in a unitary body.

6. The portable light of claim 1, wherein the first module comprises an alignment pin located on a first side and a second side, the alignment pins configured to interconnected with an alignment groove located on the second module.

7. The portable light of claim 1, wherein the first module and the second module are each configured to be separated in order to facilitate bulb replacement.

8. The portable light of claim 1, wherein the power supply cord is located external to the first module and is configured to separate from the shield housing.

9. The portable light of claim 1, further comprising a reflector attached within the shield housing.

10. The portable light of claim 1 further comprising an emissions containment housing for the ballast, the emissions housing located within the shield housing, wherein the ballast comprises an electronic ballast and filter printed circuit board.

11. The portable light of claim 1, further comprising a cap that includes a guide mechanism configured to align components of the first and second modules in a same orientation at time of assembly or reassembly.

12. The portable light of claim 11, wherein the cap is configured to absorb internal and external forces.

13. The portable light of claim 11, wherein:

the cap is configured to incorporate at least two functions into a single structure; and the single structure supports at least one stud, is configured to hold the removable bulb in place, and contains a wrapping membrane.

14. The portable light of claim 1, wherein at least the first module or the second module is configured to provide protection for an on/off switch.

15. The portable light of claim 1, further comprising a blue filter configured to interconnect with the removable bulb.

16. The portable light of claim 1, further comprising a cable conduit configured to attach to the first module, wherein the cable conduit comprises a U-shape cable conduit of a flexible material.

17. The portable light of claim 1, wherein the portable light is configured to interconnect in at least a serial configuration, a parallel configuration, or a radial configuration with at least one other portable lights.

18. The portable light of claim 17, wherein the portable light is inter-operably assembled with the at least one other portable light to be controlled individually or as a part of a group of portable lights.

19. The portable light of claim 1, wherein:

the removable bulb is a fluorescent bulb; and the ballast is an electronic ballast configured to control the removable fluorescent bulb.

20. The portable light of claim 1, wherein the portable light is configured to connect with at least one light of a similar configuration.

* * * * *